United States Patent [19]

Watts

[11] 4,263,665

[45] Apr. 21, 1981

[54] ULTRASONIC INTRUSION ALARM SYSTEM

[75] Inventor: Gary P. Watts, Buffalo Grove, Ill.

[73] Assignee: G.D.I. Electronics, Chicago, Ill.

[21] Appl. No.: 47,376

[22] Filed: Jun. 11, 1979

[51] Int. Cl.[3] ..... G08B 13/16

[52] U.S. Cl. ..... 367/94; 340/384 E; 340/528

[58] Field of Search ..... 367/94, 93; 340/528, 340/384 E

[56] References Cited

U.S. PATENT DOCUMENTS

| | | | |
|---|---|---|---|
| 3,137,846 | 6/1964 | Keeling | 340/384 E |
| 3,588,866 | 6/1971 | Schlafly, Jr. | 340/528 |
| 3,683,346 | 8/1972 | Horton | 340/384 E |
| 3,793,617 | 2/1974 | Tolman | 367/94 |

*Primary Examiner*—Glen R. Swann, III

*Attorney, Agent, or Firm*—Leo J. Aubel; Robert E. Browne

[57] ABSTRACT

An intrusion alarm system for use such as in homes including an ultrasonic motion detector having means for selectively actuating switch means for a light and a sound alarm. The circuit includes a transducer for emitting a beam of ultrasonic energy and a sensor for detecting the modulation of the ultrasonic energy by movement occurring in the beam. The sensor provides a signal in response to said modulation to turn-on an electric light, and to turn-on a sound alarm.

7 Claims, 3 Drawing Figures

ULTRASONIC INTRUSION ALARM SYSTEM

BACKGROUND OF THE INVENTION

Intrusion alarm system of various types are known in the art and range from ultrasophisticated systems designed for the protection of very valuable or secret property to basic alarm systems wherein a mechanical switch attached to a door or window is actuated to sound an alarm when the door or window is opened. It is obvious that the latter type systems protect only the particular entry way; accordingly, for a room having a number of doors or windows it may be necessary to install switches at each door or window.

Two important considerations when providing an intrusion alarm system suited for the general public is the amount of work effort, and the degree of installation expertise required of the purchaser. The ideal system is one which requires no mounting or assembly expertise whatsoever; for instance, a system which consists of a box which can be positioned in a room or merely plugged into an electrical outlet would be quite desirable.

SUMMARY OF THE INVENTION

The present invention relates to an intrusion alarm system particularly directed to the consumer or home market. The entire intrusion alarm system of the present invention including the power supply sensor alarm and logic circuitry are conveniently incorporated within a relatively small light weight box or case which may be conveniently positioned within a room or area or survey or monitor the entire room or area.

This system comprises a transducer system which emits ultrasonic energy throughout a given area and detects the modulation of the ultrasonic energy by movement occurring within the surveillance area. The modulated energy signal is then processed to actuate a sensor and provide a response to turn-on an electric light, and/or turn-on a sound alarm.

Another feature and object of the invention is to provide a police siren type of response, which is a sound increasing slowly in frequency to a selected level and then decreasing sharply to provide what is also known as a "whopper effect".

Still another feature and object of the invention is to provide an intrusion alarm system which may be connected to turn-on a light and/or a sound alarm in a neighboring home.

Another feature of the invention provides a delay response such that lights in the system turn on immediately upon actuation of the sensor and then after a short preset delay, the sound alarm is actuated for a given period. Thereafter, the sound alarm may be turned-off and the entire system rearmed or readied for actuation. Once turned-on however, the lights will remain on until the system is disconnected or turned off.

The foregoing features and advantages of the present invention will be apparent from the following more particular description of the invention. The accompanying drawings listed hereinbelow are useful in explaining the invention where:

DESCRIPTION OF INVENTION

Figures 1, 2, 3:
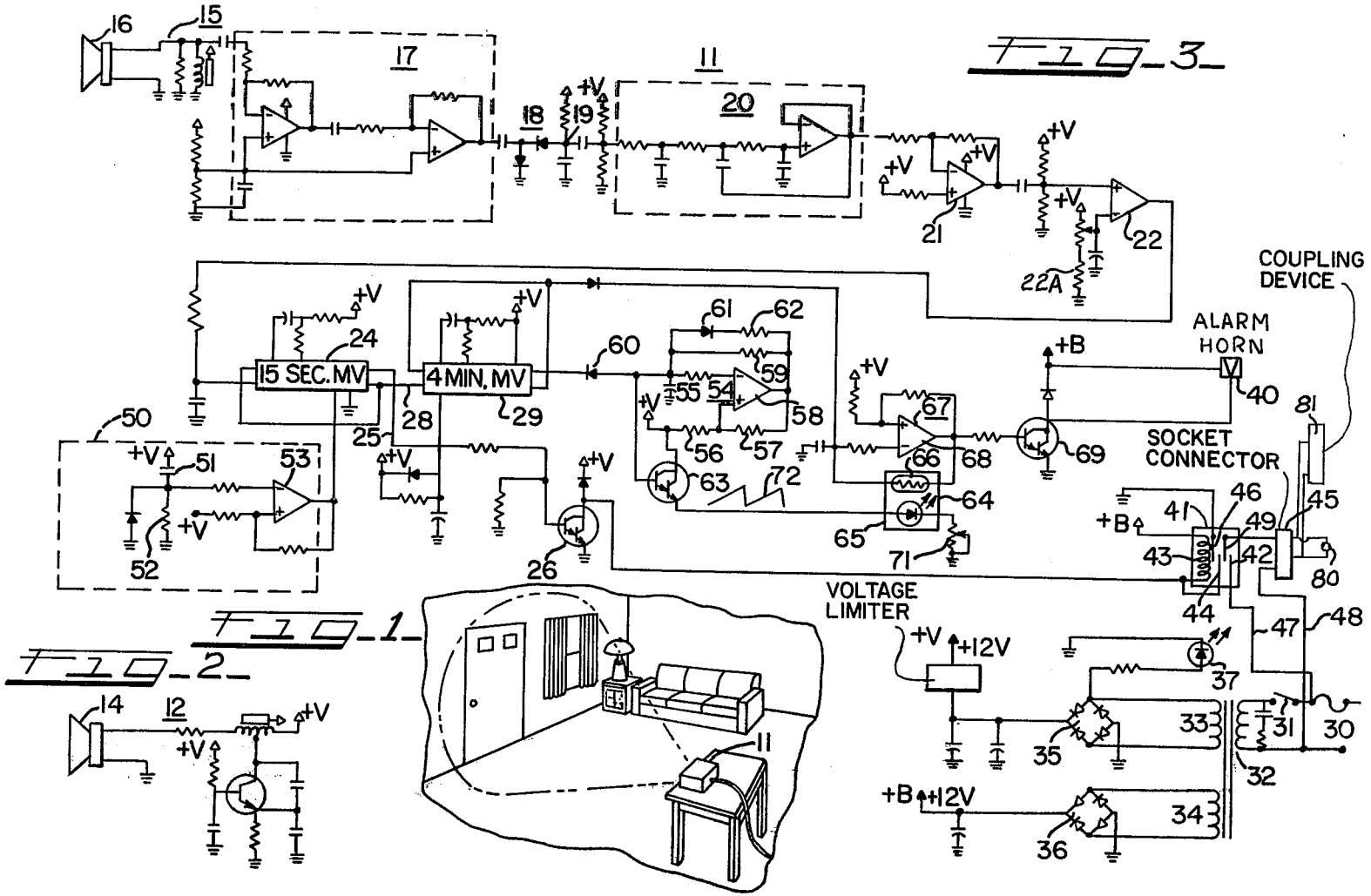
FIG. 1 is a sketch depicting the inventive intrusion alarm system in an operating environment.
FIG. 2 is a schematic diagram of an ultrasonic transmitting circuit.
FIG. 3 is a schematic diagram of a receiving circuit in accordance with the invention.

FIG. 1 is a sketch indicating the operation of the inventive intrusion alarm system 11. System 11 includes a transmitter 12 (see FIG. 2) including an ultrasonic energy transducer 14, of a suitable known type, arranged to transmit in a conical pattern as indicated by the dashed lines in FIG. 1 to blanket a selected area of surveillance. In one embodiment, transmitter 12 transmits ultrasonic energy at a frequency of 40 khz. A receiver 15 (see FIG. 3) including a transducer 16 similar to transducer 14 detects reflected sonic energy which is modulated by the movement of an intruder in the area of surveillance.

Initially, the circuitry of FIGS. 2 and 3 is turned on by plugging to an AC outlet indicated at 30 in FIG. 3. A manual switch 31 is then turned on to couple energy through the primary winding of transformer 32 to secondary windings 33 and 34, the respective diode bridges 35 and 36, and associated circuitry to provide a regulated (+V) +12 volts through a suitable voltage limiter to power the solid state circuitry of FIGS. 2 and 3, and an unregulated (+B) +12 volts to power the alarm speaker horn 40, as will be explained. An LED indicator lamp 37 is coupled to the diode bridge 35 to indicate a poweron condition.

Power from the AC line is also coupled through lead 47 to stationary contact 42 of a known type relay 41. The coil 43 of relay 41 is normally not energized and the connection from the AC power line to contact 42 is thus effectively open. Block 45 depicts a connection to the socket or sockets of the house lights or lamps. As will be explained, whenever coil 43 of relay 41 is energized, movable arm 49 of relay 41 is actuated to contact stationary contact 42 to connect power from AC outlet 30 through leads 47 and 48 to connection block 45 to energize and light the associated house lights or lamps indicated as 80.

The circuit of FIG. 3 may also be electrically coupled to an auxiliary coupling device 81, of suitable known type, which can couple a control signal through the power line, and in conjunction with an associated known type receiving unit, not shown, energize and light a light in an adjacent i.e. neighboring house.

When the circuits of FIGS. 2 and 3 are initially energized or activated, it is desirable for the person turning on the switch 31 to have sufficient time to leave the area of surveillance so that the person's motion will not cause the circuit of FIG. 3 to respond. Accordingly, a half-a-minute to one minute delay circuit may be provided. More specifically, when switch 31 turns the power on, the regulated voltage (+V) provided from transformer 32 powers a thirty-second delay subcircuit 50 (left side of FIG. 3). A relatively large capacitor 51 in conjunction with the series connected resistor 52 provides a voltage through operational amplifier 53 to delay the firing of one-shot multivibrator 24 for thirty seconds. At the end of the thirty-second time delay, the delay subcircuit 50 permits the one-shot multivibrator 24 to be enabled or armed and ready for activation upon the receipt of a trigger pulse as will be explained.

As is well known, transducer 16 (upper left of FIG. 3) receives the energy reflected within the surveillance area; or more specifically, an object moving in the path of the transmitted energy will reflect a modulated energy back toward the transducer 16. The reflected energy is sensed by transducer 16, and amplified in a two-stage amplifier indicated generally as 17. The output of the two-stage amplifier 17 is a ten-volt, peak-to-peak, signal at a freqency of 40 khz. A detector and rectifier subcircuit indicated generally as 18, filters out the 40 khz frequency. So long as there is no movement in the area of surveillance, the output at terminal 19 is essentially zero. However, as mentioned above, if there is movement in the area of surveillance, the energy at 40 khz frequency will be modulated by the movement of the object; i.e., the intruder will develop a signal at the output of detector and rectifier 18 or terminal 19. The output from the detector rectifier 18 is coupled to a three-stage low pass filter indicated generally as 20. The output of the filter 20 is a low frequency signal which is coupled through series connected operational amplifiers 21 and 22. Amplifier 22 is connected as a differential amplifier, and has one of its inputs connected to a series resistor ladder 22A, and function to control the sensitivity of the circuit of FIG. 3 in sensing or monitoring any movement within the surveillance area. The output of amplifier 22 is a square wave pulse which triggers the one-shot multivibrator 24.

As mentioned above, after the 30 second initial delay, the multivibrator 24 is armed. Any subsequent motion in the field of surveillance will cause the square wave input pulse from amplifier 22 to trigger multivibrator 24. Multivibrator 24 will in turn provide a pulse through lead 25 to turn on transistor pair 26 to thereby energize the relay coil 43 to cause relay contact arem 49 to close against contact 42 and turn-on the associated lamps 80 through sockets 45. Movable contact 46 also closes against stationary contact 44 when coil 43 is energized to latch-on (as is known in the art), and maintains coil 43 energized independently of the operation of the remainder of the circuit of FIG. 3, to thus cause the associated lamps or lights 80 connected to socket block 45 to remain on.

At the termination of 15 seconds after receipt of a pulse from amplifier 22, multivibrator 24 switches states and causes a trigger pulse to be provided through lead 28 to another one-shot multivibrator 29 to provide a four minute positive square wave output pulse. The output from the one-shot multivibrator 29 is coupled to reverse connected diode 60 to enable oscillator circuit 54.

The oscillator circuit 54 including operational amplifier 58 operates at a frequency of 0.5 hz to 1 hz. Oscillator circuit 54 also includes a capacitor 55 connected to charge from +V through resistors, 56, 57 and 59. Capacitor 55 requires a relatively long time to charge through the foregoing resistors. When capacitor 55 reaches a present level, it turns-on transistor 63. With transistor 63 turned-on, capacitor 55 discharges relatively quickly controlled by the path of diode 61, resistor 62 (which is approximately one-twentieth the resistance 59), resistors 56 and 57, transistor 63 and opto-coupler 65 through movable resistor 71 to ground. The approximate charge and discharge waveform is indicated at 72. Oscillator 58 oscillates between 0.5 hz to 1 hz at the charge and discharge rate of capacitor 55. The current through opto-coupler 65, and thus the resistance of resistor 66, varies at the charge and discharge rate capacitor 55.

A second oscillator circuit 67 includes an operational amplifier 68 which oscillates at a frequency of 2 to 3 khz. Resistor element 66 is connected across oscillator 68, and the frequency of oscillator 68 is varied at a rate dependent on the resistance of resistor element 66, and hence on the charge and discharge rate of capacitor 55.

The output of oscillator circuit 67 is connected through transistor 69 to drive the alarm speaker horn 40. The output of oscillator circuit 67 is thus a varying frequency having an increasingly higher frequency sound which is abruptly terminated and then repeated, such as a police siren, to provide a so-called "whopping" sound.

The alarm horn 40 continues to be activated for the four minute period of a multivibrator 29. If the modulated input to the receiver circuit of FIG. 3 is terminated, that is, if the intruder has left the area of surveillance, the horn 40 will be silenced after four minutes. Note, however, that the lights 80 remain on, giving information that the alarm has been tripped. After the multivibrator 29 is turned off, the circuit of FIG. 3 will again activate the alarm horn 40 if there is a subsequent entry into the area of surveillance.

While the invention has been particularly shown and described with reference to a preferred embodiment thereof, it will be understood by those skilled in the art, that various changes in form and details may be made therein without departing from the spirit and scope of the invention.

I claim:

1. An intrusion alarm system comprising, in combination, means for receiving a signal comprising reflected ultrasonic frequency energy modulated by an object moving in a selected field, means for demodulating said signal and providing a control pulse, bistable circuit means for receiving said control pulse and providing first and second output signals, relay means responsive to said first output signal to cause associated lights to be turned-on, capacitor circuit means responsive to said second output signal to permit said capacitor circuit means to charge and discharge, first oscillator means oscillating at frequency varying within a first range and responsive to the charge and discharge rate of said capacitor circuit means, second oscillator means responsive to the varying frequency output of said first oscillator and oscillating at a frequency within a second range and at a varying rate determined by said output of said first oscillator, and a speaker horn coupled to said second oscillator whereby the output of said speaker horn is an increasingly higher frequency sound abruptly terminated and then repeated.

2. An apparatus as in claim 1 wherein said bistable circuit means comprise first and second one shot multivibrators.

3. An apparatus as in claim 1 further including optical coupler means connected to said first oscillator, said coupler including a resistance element whose resistance varies in response to the oscillations of said first oscillator, and means coupling said resistance element in said second oscillator circuit for varying the frequency of said second oscillator dependent on the resistance of said resistance element.

4. An apparatus as in claim 2 further including means for disabling said first multivibrator for a selected period after initial turn-on of the system.

5. An apparatus as in claim 2 wherein said first and second multivibrator are connected in series, and said second multivibrator is activated by said first multivibrator a preselected time after the associated lights are turned on.

6. An apparatus as in claim 1 including latching means for said relay means such that the associated lights remain on when the intrusion alarm system is activated by an object.

7. An apparatus as in claim 2 wherein said second one shot multivibrator selectively permits said capacitor circuit means to charge and discharge essentially as a saw tooth wave.

* * * * *